US006000569A

United States Patent [19]

Liu

[11] Patent Number: 6,000,569

[45] Date of Patent: Dec. 14, 1999

[54] PEDAL TYPE DUSTBIN STRUCTURE

[76] Inventor: Ching-Rong Liu, No. 10, Sung-Chiang N. Rd., Chung-Li City, Taiwan

[21] Appl. No.: 09/145,984

[22] Filed: Sep. 3, 1998

[51] Int. Cl.[6] ..... B65D 43/16

[52] U.S. Cl. ..... 220/263; 312/319.9

[58] Field of Search ..... 220/263, 264, 220/262; 312/319.9

[56] References Cited

U.S. PATENT DOCUMENTS

| | | | |
|---|---|---|---|
| 5,163,574 | 11/1992 | Susan | 220/263 |
| 5,249,693 | 10/1993 | Gillispie et al. | 220/263 |
| 5,295,607 | 3/1994 | Chang | 220/263 |
| 5,372,271 | 12/1994 | Miller et al. | 220/263 |
| 5,531,348 | 7/1996 | Baker et al. | 220/263 |
| 5,538,338 | 7/1996 | Biggus | 220/263 |

*Primary Examiner*—Joseph M. Moy
*Attorney, Agent, or Firm*—Bacon & Thomas

[57] ABSTRACT

A pedal type dustbin structure, especially such a dustbin structure wherein a lid can be closed slowly to prevent the lid from emitting noise of collision during down closing thereof is disclosed. The dustbin is comprised of a receiving main body and an operating member, wherein, the receiving main body is comprised of a main frame, a top frame, an upper pulling door, a lower pulling door and two receiving bins. Further, the operating member is comprised of a lid, an operating rod, a cylindrical-member fixing-seat, an air-controlled member and a pedal. Wherein, the pedal can control up/down movement of the operating rod to lift and close the lid. The relative movement between the cylindrical-member fixing-seat and the air-controlled member makes slow down closing of the lid, so that noise of collision during down closing of the lid can be prevented. The dustbin is designed to have two receiving bins in the main frame, thus an object of classification of garbage can be obtained. Provision of the lid and the upper and lower pulling doors can get the effect of stink removing and insect proofing.

5 Claims, 6 Drawing Sheets

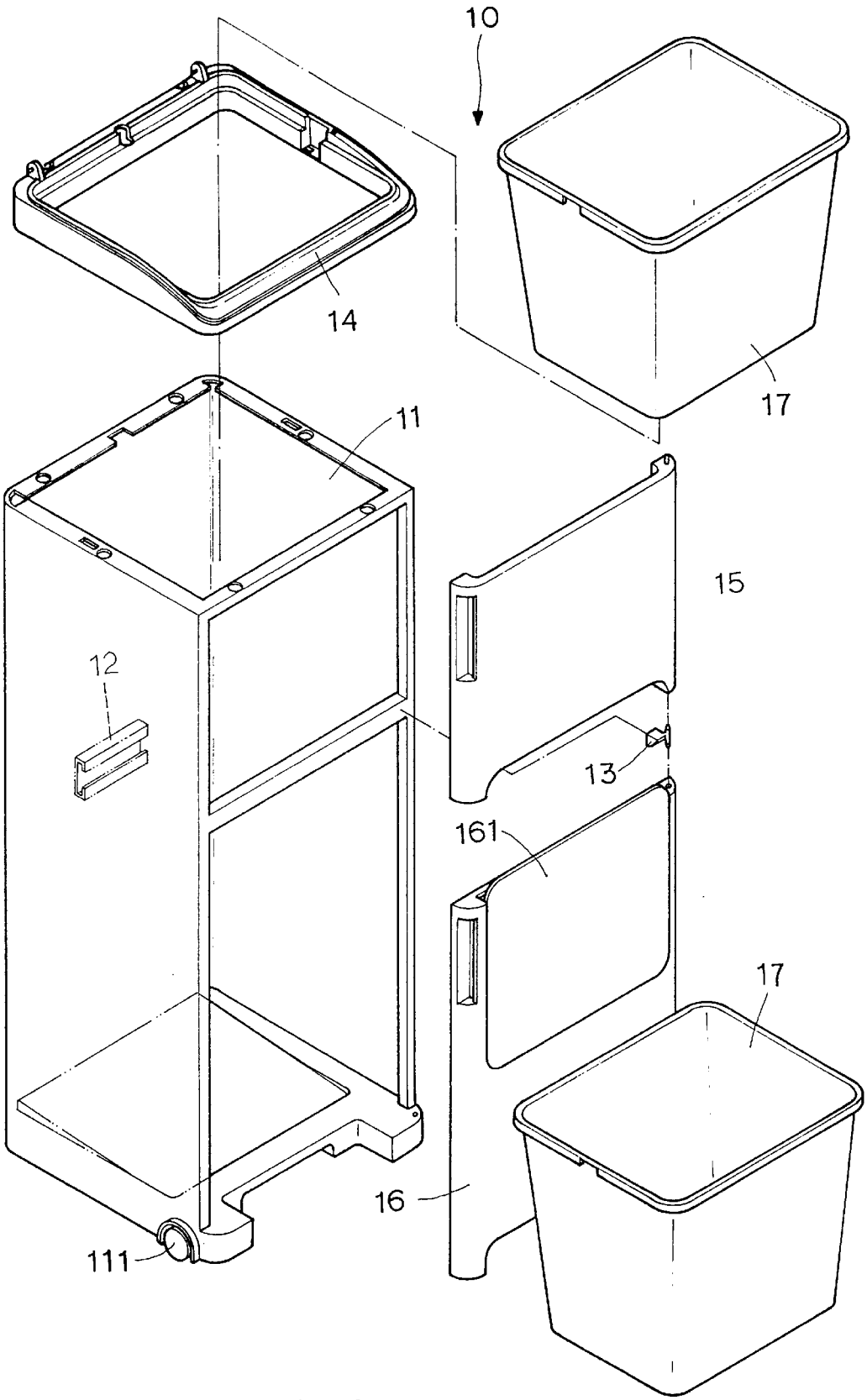
Fig. 2—1

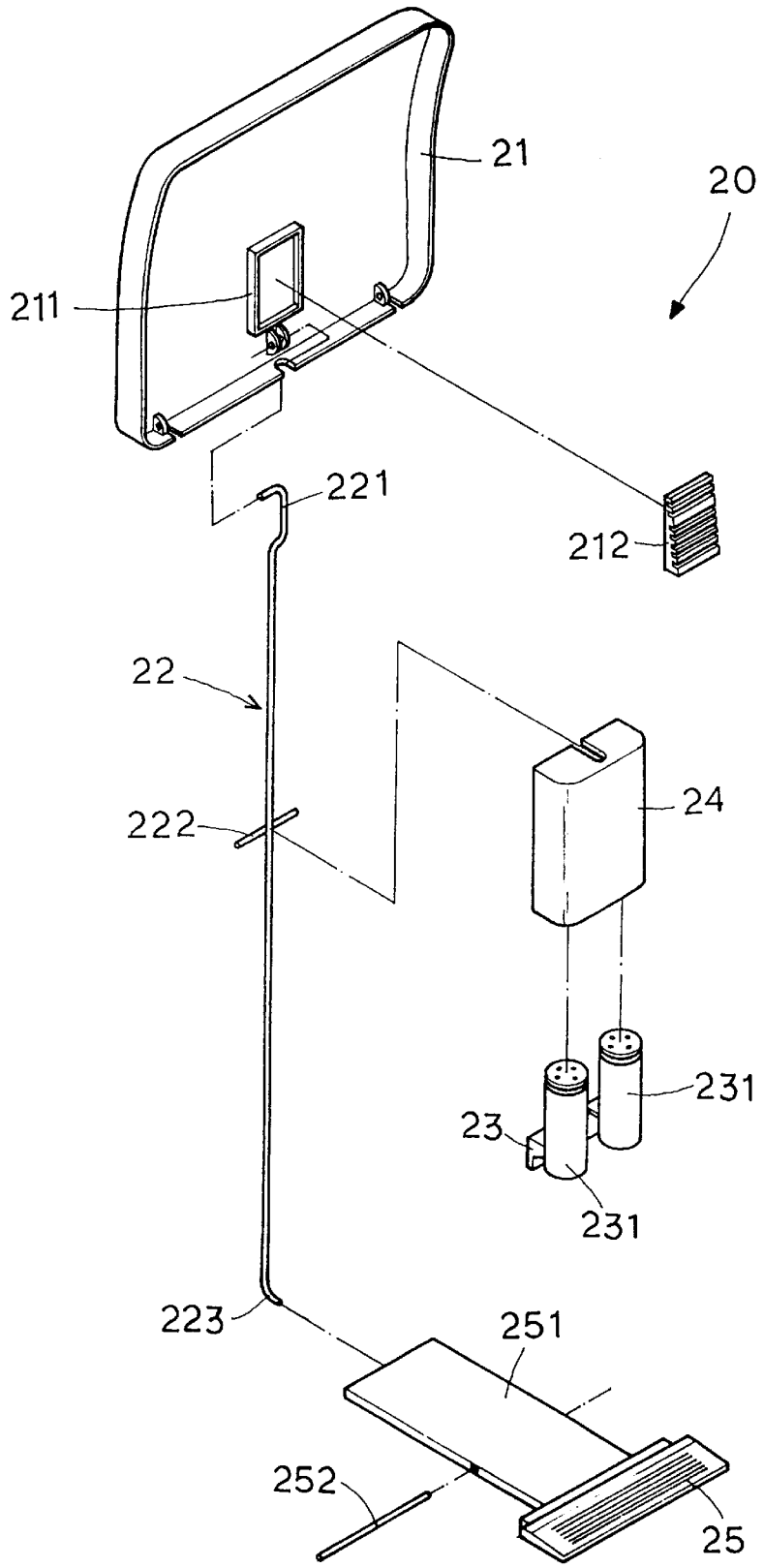
Fig. 2—2

PEDAL TYPE DUSTBIN STRUCTURE

BACKGROUND OF THE INVENTION

1. Field of the Invention

The present invention is related to a pedal type dustbin structure, and especially to such a pedal type dustbin structure allowing garbage to be placed therein in a classified mode by using two receiving bins. A lid and an upper and a lower pulling door are provided thereon to get an effect of insect proofing and odor insulation.

2. Description of the Prior Art

Conventional dustbins sold in the markets are generally divided into a non-lid type and a lid-on type; wherein, the lid-on type is further divided into a manual type and a pedal type. A dustbin without a lid not only is subjected to luring mosquitoes and flies, but also is very easy to render the garbage therein to drop out by inadvertent collision. While a manual lid-on type dustbin can solve the disadvantage resided in a non-lid type dustbin. However, a user shall lift the lid when in discarding garbage, and close the lid after that, such procedure is inconvenient and bothersome as well as tends to make the hands of the user dirt. Hence pedal type dustbins are more and more popularly used under the trend of meeting sanitation and convenience. Such pedal type dustbins not only can get rid of the disadvantage resided in a non-lid type dustbin, but can also get rid of the inconvenience resided in a lid-on type dustbin. However, conventional pedal type dustbins mainly take advantage of pedals in controlling a link each, the link is activated to lift a lid. Such a control mode on the lid can obtain an object of lifting as well as closing the lid, however, the down closing speed of the lid is uncontrollable, at the moment of closing, a bump noise can be created, improvement therefore is wanted. Besides, a manual type or a pedal type dustbin neither can provide a function of classifying garbage, so that difficulty exists in dealing with garbage by using them.

SUMMARY OF THE INVENTION

The inventor of the present invention develops and provides a pedal type dustbin structure being more convenient for use and more coincident to requirements of environmental conservation after continuous study, improvement and tests. The provision is based on his experience of years in studying and designing the similar products and by putting huge spirit and energy of himself into solving the problems and disadvantages resided in the conventional dustbins.

Therefore, the primary object of the present invention is to provide a pedal type dustbin structure comprised mainly of a receiving main body and an operating member. Wherein, the main body is comprised of a main frame, a top frame, an upper pulling door, a lower pulling door and two receiving bins. The operating member is comprised of a lid, an operating rod, a fixing seat for two cylindrical members, an air-controlled member and a pedal. The upper and the lower pulling doors are provided for classifying of garbage. The lid and the upper and the lower pulling doors are provided to prevent flying of mosquitoes or flies all over, the lid can also be provided therein with a cassette for stink removing agent or insecticide to keep the dustbin sanitary.

Another object of present invention is to provide a dustbin structure of which the lid is closed slowly. Wherein, the fixing seat for cylindrical members is mounted with two cylindrical members, and the air-controlled member is provided with two cylindrical member holders, an air chamber is provided in each holder, and an air vent with a fine bore is provided on the upper wall of each holder. When the pedal is pressed down to lift the lid, the air-controlled member is moved upwardly by operation of the operating rod to allow air to come into the air chambers. While if the pedal is released from pressing, air in the air chambers is released slowly through the air vents, so that the lid can be closed down slowly.

The present invention will be more apparent after reading the detailed description of the preferred embodiment thereof in reference to the accompanying drawings.

BRIEF DESCRIPTION OF THE DRAWINGS

In the drawings:

FIG. 2-1 is an analytic perspective view showing a receiving main body of the present invention;

FIG. 2- 2 is an analytic perspective view showing an operating member of the present invention;

DETAILED DESCRIPTION OF THE PREFERRED EMBODIMENT

Figure 1:
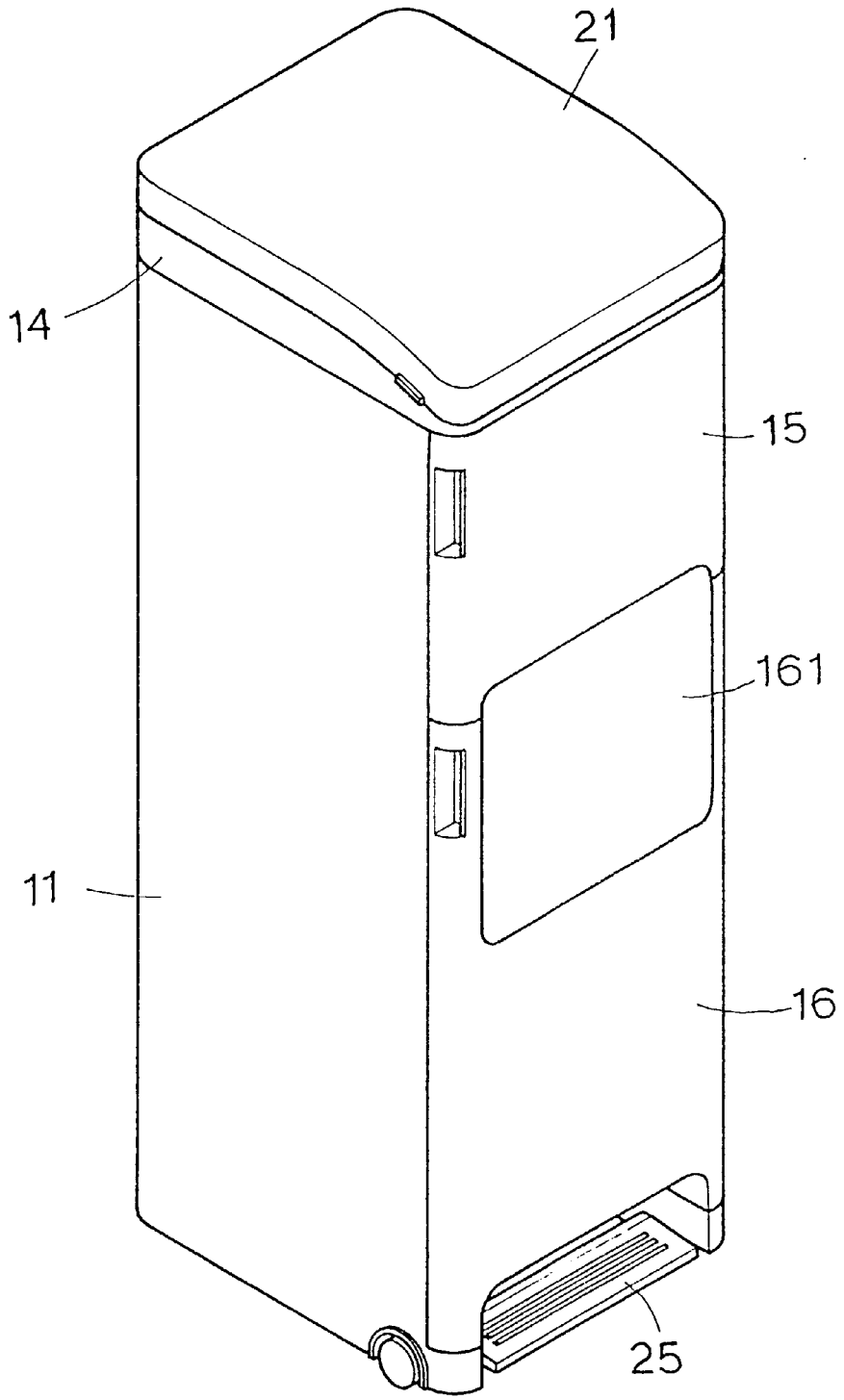
FIG. 1 is a perspective view of the present invention.
Figure 3:
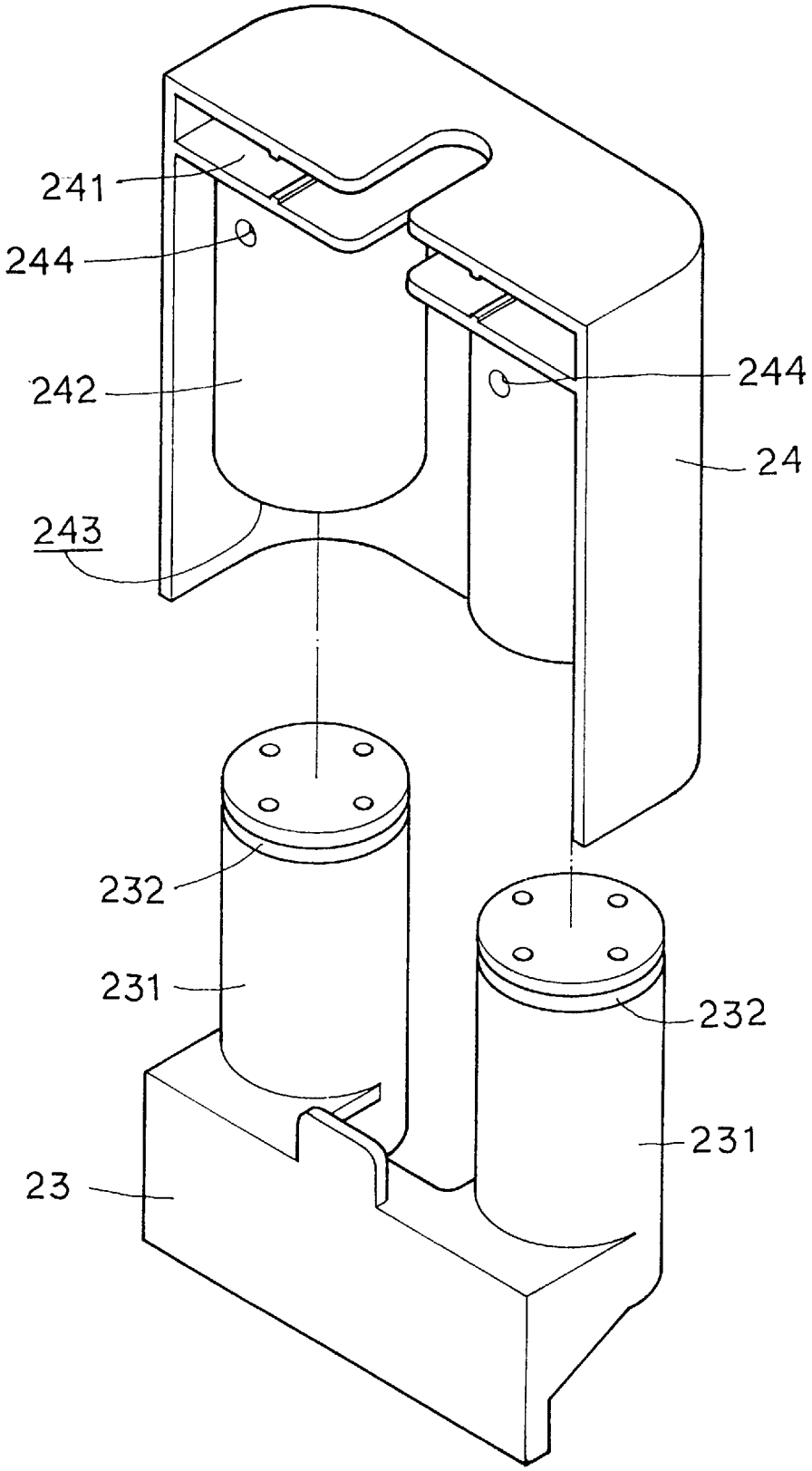
FIG. 3 is an analytic perspective view showing a fixing seat for cylindrical members and an air-controlled member of the present invention.

Referring to FIG. 1, 2-1, 2-2 and 3, the dustbin of the present invention is mainly comprised of a receiving main body 10 and an operating member 20. Wherein, the main body 10 is comprised of a main frame 11, a top frame 14, an upper pulling door 15, a lower pulling door 16 and two receiving bins 17. The main frame 11 is fixedly provided therein with a C shaped fixing member 12, and is provided on the front surface thereof with a pivot joint 13 for mounting thereon the upper pulling door 15 and the lower pulling door 16. The top frame 14 is fixed on the main frame 11 of which the front end is pivotally mounted the upper pulling door 15 and the lower pulling door 16. The lower pulling door 16 is mounted on the top thereof with a pivotable sheet 161 hanging thereon to be pushable inwardly for placing in garbage. The two receiving bins 17 are placed one inside of the lower pulling door 16 and the other one under the top frame 14 respectively.

The operating member 20 is comprised of a lid 21, an operating rod 22, a cylindrical-member fixing-seat 23, an air-controlled member 24 and a pedal 25. Wherein, the lid 21 is fixedly mounted on the top frame 14, and is provided on the inner surface thereof with a positioning frame 211 on which a movable cassette 212 is provided for receiving stink agent. The free end of the operating rod 22 is bent to form a hook 221 extending through the top frame 14 and being fixedly connected to the lid 21. A control rod 222 is provided at the center of the operating rod 22, a bending end 223 which is the other free end of the operating rod 22 extends through the bottom of the main frame 11 to connect with the pedal 25. A plate 251 is connected to the rear of the pedal 25 and is fixed to the bottom of the main frame 11 with an axle rod 252, and further is connected fixedly to the bending end 223 of the operating rod 22. Moreover, the cylindrical-member fixing-seat 23 is fixed to the fixing member 12 of the main frame 11, it is integrally formed on the front side thereof with two cylindrical members 231 of which the tops are provided with two sealing members 232. The air-controlled member 24 is provided on the upper area thereof with two receiving chambers 241, two cylindrical member holders 242 are connected to the bottoms of the receiving chambers 241. The cylindrical member holders 242 have therein air chambers 243, and an air vent 244 with a fine bore is provided on the upper wall of each of the cylindrical member holders 242. The receiving chambers 241 of the air-controlled member 24 allow insertion of the control rod 222 of the operating rod 22 therein. The cylindrical member holders 242 can be exactly fitted over the two cylindrical members 231 and of which the air chambers 243 can be nearly fully sealed by means of the two sealing members 232.

The operating member 20 makes opening/closing of the lid 21, and achieves a function/object of making slow down moving of the lid 21 onto the top frame 14. When the pedal 25 is pressed down, the rear end of the plate 251 is moved upwardly to move up the operating rod 22 to raise the air-controlled member 24 and thereby to lift the lid 21. While if the pedal 25 is released from pressing, relative motion between the air-controlled member 24 and the cylindrical members 231 can make the lid 21 and the operating rod 22 descent slowly. Thereby prevents the lid 21 from emitting noise of collision during down closing thereof and increase life of use of the dustbin.

Figure 5:
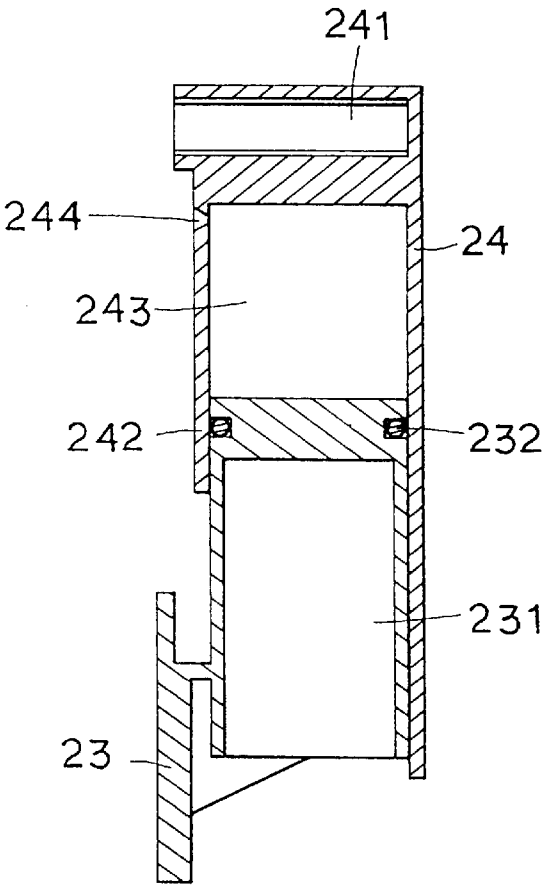
FIG. 5 is a schematic sectional view showing operation of the fixing seat for cylindrical members and the air-controlled member of the present invention (wherein the lid is closed)
Figure 4:
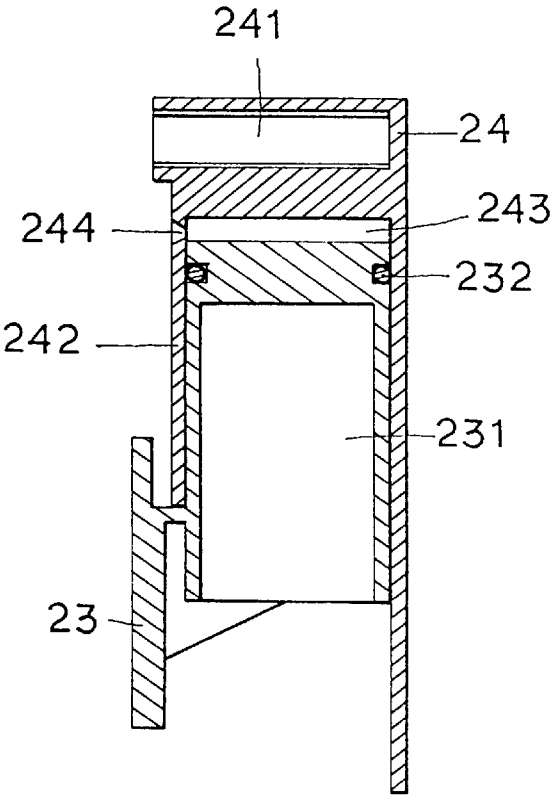
FIG. 4 is a schematic sectional view showing operation of the fixing seat for two cylindrical members and the air-controlled member of the present invention (wherein a lid is lifted and opened)

Referring to FIGS. 3 to 5, the cylindrical-member fixing-seat 23 is provided with a pair of cylindrical members 231, on which there are provided the two sealing members 232. The receiving chambers 241 are located on the upper area of the air-controlled member 24, and are provided on the bottoms thereof with the cylindrical member holders 242 corresponding to the cylindrical members 231 of the cylindrical-member fixing-seat 23. The air chambers 243 inside of the cylindrical member holders 242 can be exactly fitted over the two cylindrical members 231.

When the air-controlled member 24 is raised, air comes into the air chambers 243 through the air vents 244 to enlarge the volume of the air chambers 243. While when the air-controlled member 24 is lowered, the air in the cylindrical member holders 242 is gradually released through the air vents 244 and the volume of the air chambers 243 is gradually reduced to obtain the object of slow moving down of the air-controlled member 24.

Figure 6:
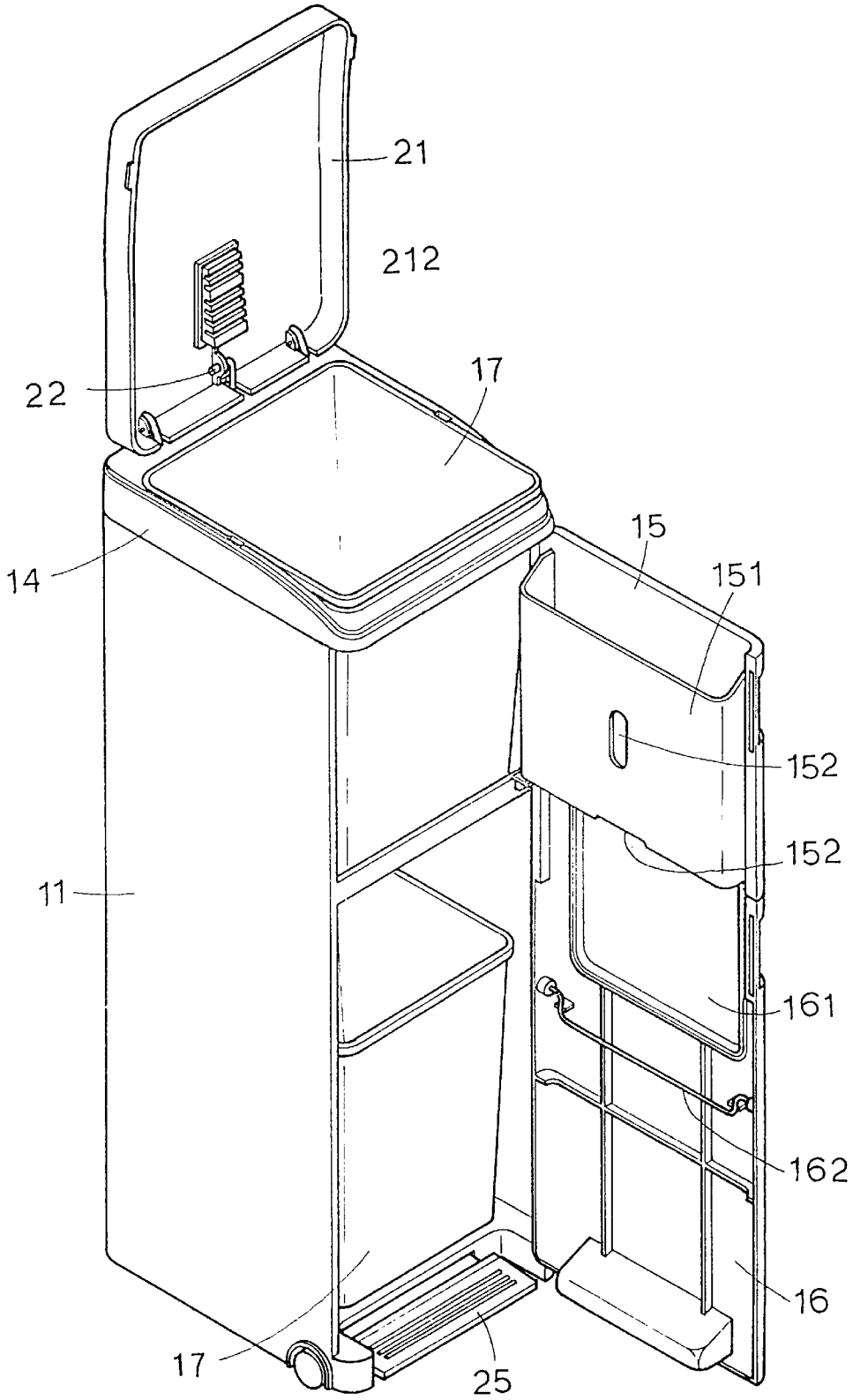
FIG. 6 is a perspective view showing the present invention after assembling and being in an open state.

Referring to FIG. 6, wherein it is shown that, when the dustbin of the present invention is assembled, the lid 21 can be lifted by pedaling the pedal 25. Thus the upper pulling door 15 and the lower pulling door 16 in front of the main frame 11 can be opened. The upper pulling door 15 can be provided inside thereof with a receiving case 151 for garbage bags etc. The receiving case 151 is provided with one or more holes 152 for convenience of drawing out the garbage bags. The lower pulling door 16 is provided inside and at the center thereof with a hanger 162 for rags etc. When the lower pulling door 16 is pulled down to open, the lower one of the receiving bins 17 is moved out for dumping. The upper one of the receiving bins 17 can be taken out by lifting the lid 21.

In conclusion, the dustbin of the present invention can have the effect of preventing flying all over of mosquitoes or flies, stink removing, insect proofing and garbage classifying. The lid 21 can be closed down slowly by operation of the cylindrical-member fixing-seat 23 and the air-controlled member 24 to achieve the object of preventing the lid 21 from emitting noise of collision during, down closing thereof.

While a preferred embodiment of the present invention has been known and described hereinabove, it is apparent that various changes and modifications might be made without departing from the scope of the invention which is set forth in the accompanying claims. Having thus described my invention, what I claim as new and desire to be secured by Letters Patent of the United States are:

1. A pedal type dustbin structure comprised of a receiving main body and an operating member, wherein, said receiving main body is comprised of a main frame, a top frame, an upper pulling door, a lower pulling door and two receiving bins, further, said main frame is fixedly provided therein with a fixing member, and is provided on the front surface thereof with a pivot joint, said top frame is fixed on said main frame of which the front end is pivotally mounted with said upper pulling door and said lower pulling door, said two receiving bins are placed one inside of said lower pulling door and the other one under the top frame respectively, said lower pulling door is mounted on the top thereof with a pivotable sheet hanging thereon to be pushable inwardly for placing in garbage;

said operating member is comprised of a lid, an operating rod, a cylindrical-member fixing-seat, an air-controlled member and a pedal, wherein, said lid is fixedly mounted on said top frame, and one end of said operating rod is bent to form a hook fixedly connected to said lid, a control rod is provided at the center of said operating rod, a bending end which is the other end of said operating rod extends through the bottom of said main frame;

said cylindrical-member fixing-seat is fixed to said fixing member of said main frame, and is integrally formed on the front side thereof with two cylindrical members of which the tops are provided with two sealing members;

said air-controlled member is provided on the upper area thereof with two receiving chambers in which a control rod is fixed, two cylindrical member holders are connected to the bottoms of said receiving chambers, said cylindrical member holders are exactly fitted over two cylindrical members and have therein air chambers, and an air vent with a fine bore is provided on the upper wall of each of said cylindrical member holders;

a plate is connected to the rear of said pedal and is fixed to the bottom of said main frame with an axle rod, and further is connected fixedly to said bending end of said operating rod;

when said pedal is pressed down to lift said lid, said air-controlled member is moved upwardly by operation of said operating rod to allow air to come into said air chambers, while if said pedal is released from pressing, air in said air chambers is released slowly through said air vents, so that said lid can be closed down slowly.

2. An pedal type dustbin structure as claimed in claim 1, wherein, said operating member is provided on the inner surface thereof with a positioning frame on which a movable cassette is provided for receiving stink agent, so that an effect of stink removing and insect proofing can be achieved.

3. An pedal type dustbin structure as claimed in claim 1, wherein, said upper pulling door is provided inside thereof with a receiving case for garbage bags etc.

4. An pedal type dustbin structure as claimed in claim 3, wherein, said receiving case is provided with one or more holes for convenience of drawing out said garbage bags.

5. An pedal type dustbin structure as claimed in claim 1, wherein, said lower pulling door is provided inside thereof with a hanger for rags.

* * * * *